United States Patent [19]

Watanabe

[11] Patent Number: 4,814,686

[45] Date of Patent: Mar. 21, 1989

[54] FET REFERENCE VOLTAGE GENERATOR WHICH IS IMPERVIOUS TO INPUT VOLTAGE FLUCTUATIONS

[75] Inventor: Yohji Watanabe, Kawasaki, Japan

[73] Assignee: Kabushiki Kaisha Toshiba, Kawasaki, Japan

[21] Appl. No.: 12,345

[22] Filed: Feb. 9, 1987

[30] Foreign Application Priority Data

Feb. 13, 1986 [JP] Japan ..... 61-29305

[51] Int. Cl.[4] ..... G05F 3/24

[52] U.S. Cl. ..... 323/229; 307/304; 323/312; 323/313

[58] Field of Search ..... 323/229, 231, 313, 223, 323/303, 312; 307/304

[56] References Cited

U.S. PATENT DOCUMENTS

| | | | |
|---|---|---|---|
| 3,806,742 | 4/1974 | Powell | 323/313 |
| 3,823,332 | 7/1974 | Feryszka et al. | 330/35 |
| 4,454,467 | 6/1984 | Sakaguchi | 323/313 |
| 4,641,081 | 2/1987 | Sato et al. | 323/313 |

FOREIGN PATENT DOCUMENTS

| | | | |
|---|---|---|---|
| 85111 | 5/1982 | Japan | 323/231 |
| 549795 | 3/1977 | U.S.S.R. | 323/313 |
| 2081940 | 2/1982 | United Kingdom . | |

OTHER PUBLICATIONS

K. Itoh et al. "An Experimental 1 Mb DRAM with On-Chip Voltage Limiter" ISSCC Dig. Tech. Paper p. 282 (1984).

T. Mano et al. "Circuit Techniques for a VLSI Memory." IEEE J. Solid-State Circuits vol. SC-18, p 463 (1983).

*Primary Examiner*—William H. Beha, Jr.

*Attorney, Agent, or Firm*—Oblon, Fisher, Spivak, McClelland & Maier

[57] ABSTRACT

A reference d.c. voltage generator is disclosed which includes a series circuit for first and second field effect transistors or FETs. The first FET serves as a high-impedance constant current supply, while the second FET functions as a resistor for generating at its soure a reference d.c. voltage. A series circuit of two FETs is connected between the gate and source of the first FET to bias the first FET such that a current flowing therein is kept constant, whereby the gate-source voltage thereof can be stabilized even when the power supply voltage is fluctuated.

11 Claims, 1 Drawing Sheet

FET REFERENCE VOLTAGE GENERATOR WHICH IS IMPERVIOUS TO INPUT VOLTAGE FLUCTUATIONS

BACKGROUND OF THE INVENTION

The present invention relates to the stabilization of a reference d.c. voltage for a semiconductor integrated circuit device having insulated gate field effect transistors.

Recently, reference d.c. voltage generators have been proposed for use in semiconductor integrated circuit (IC) devices to generate stabilized reference d.c. voltages. These voltage generators are normally comprised of semiconductor transistor circuits which are mounted on semiconductive chip substrates of the IC devices. Such on-chip voltage generators receive an external power supply voltage (Vcc) to produce a d.c. voltage. A problem with such devices is that the d.c. potential output level of a reference voltage generator changes with variation or fluctuation in the power supply voltage. If the reference voltage level is changed, a threshold level for determining logic "H" and "L" levels is deviated to thereby degrade the inner logic circuit operations of the semiconductor IC devices.

It is known, in the prior art, that a potential-divider circuit is used as the reference d.c. voltage generator. This circuit is typically formed of a series circuit of insulated gate field effect transistors (FETs) serving as resistive elements. The circuit is supplied, at one terminal, with a d.c. power supply voltage (battery voltage) Vcc to present a given fraction of the voltage Vcc at an output terminal, which is connected to a junction between the FETs. The output d.c. voltage may be supplied to an IC device as the reference voltage. The division of the potential at the output terminal depends upon the magnitudes of the resistances in the potential divider.

In such a circuit configuration, however, accurate stabilization of the reference voltage cannot be expected. This is because the accuracy of stabilization of the reference voltage level should depend upon supplying the potential-divider circuit with a stabilized d.c. power supply voltage. If a potential level of the externally applied voltage fluctuates, it is not possible to obtain an accurate d.c. reference voltage. The result is that the stabilization of reference voltage output level cannot work well.

Further, in the aforementioned voltage generator the voltage-controlling FETs have deviations in their fundamental characteristics due to variations in process parameters, such as gate oxide film thickness, carrier mobility, fabricated size, etc., caused in the manufacturing process thereof. The controlling performance of FETs cannot be set uniform among IC devices in the same manufacturing lots, so that the accuracy of the stabilization of reference voltage output level will be deviated among semiconductor IC devices, which makes it impossible to stabilize a reference voltage in every IC device.

SUMMARY OF THE INVENTION

It is therefore an object of the present invention to provide a new and improved d.c. voltage generator used in a semiconductor integrated circuit device for effectively stabilizing a reference voltage output level thereof irrespective of fluctuation of power supply voltage.

It is another object of the present invention to provide a new and improved d.c. voltage generator used in a semiconductor integrated circuit device for effectively stabilizing the reference voltage output level thereof irrespective of fluctuation of power supply voltage and variation of process parameters among semiconductor integrated circuit devices in the manufacture thereof.

In accordance with the above objects, the present invention is addressed to a specific device for generating a reference voltage output level. This device comprises a first transistor unit for serving as a constant current source which receives an externally applied power supply voltage to generate a d.c. current. A second transistor unit is connected in series to the first transistor unit, for serving as a resistor element which receives the d.c. current to generate a d.c. voltage as the reference voltage. A third transistor unit is connected in parallel with the first transistor unit to control the d.c. current flowing in the first transistor unit in such a manner that it is kept constant irrespective of change in the power supply voltage, whereby the reference voltage can be stabilized even when the power supply voltage is deviated or fluctuated.

The invention, and its objects and advantages, will become more apparent in the detailed description of preferred embodiments presented below.

BRIEF DESCRIPTION OF THE DRAWINGS

In the detailed description of a preferred embodiment of the invention presented below, reference is made to the accompanying drawings in which.

DETAILED DESCRIPTION OF PREFERRED EMBODIMENT

Figure 1:
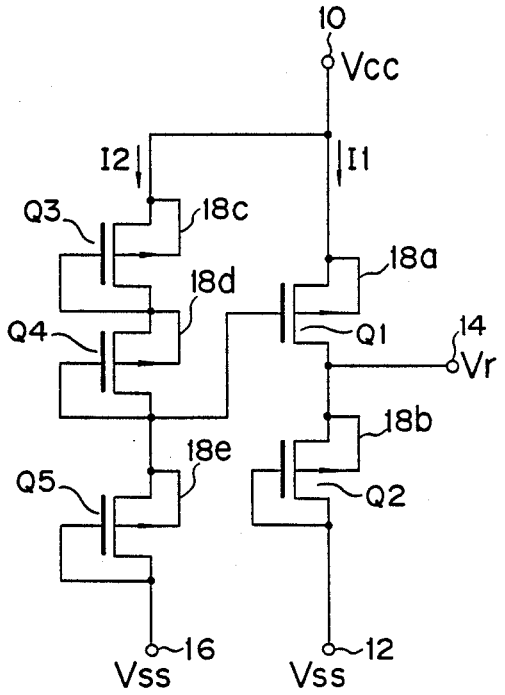
FIG. 1 is a diagram showing a circuit configuration of a reference voltage generator in accordance with one preferred embodiment of the present invention.

Referring now to FIG. 1, there is shown an on-chip reference voltage generating circuit which is used in a semiconductor integrated circuit (IC) device having insulated gate field effect transistors, such as metal oxide semiconductor field effect transistors (referred to as "MOSFETs" hereinafter). The voltage generator receives power supply voltage Vcc externally applied thereto to produce a d.c. reference voltage Vr. The voltage generator is comprised of the same channel type MOSFETs. In this embodiment, the voltage generator includes p-channel type MOSFETs Q1, Q2, Q3, Q4 and Q5.

These p-channel type MOSFETs Q1 to Q5 are respectively formed in highly doped semiconductive well regions of n conductivity type, which are separately formed in a semiconductor chip substrate of p type silicon (not shown). Such a configuration may be fabricated using a known semiconductor manufacturing technique. The structural separation of MOSFETs Q1 to Q5 in the substrate can lead to the improvement of the operational separation thereamong, since deviation in their threshold levels due to the substrate biassing effect can be minimized.

MOSFETs Q1 and Q2 are connected in series between first and s3econd voltage terminals 10 and 12. A voltage applied to first terminal 10 is higher than that applied to the second threshold. In this embodiment, power supply voltage Vcc of positive polarity is applied to first terminal 10, while second terminal 12 is grounded (Vss). MOSFET Q1 is connected at a source electrode to the first terminal, that is power supply terminal 10 to serve as a high-impedance current source. MOSFET Q2 is connected at a drain electrode to second terminal or ground terminal 12 to function as a resistor element. The drain electrode of MOFSET Q1 and the source electrode of MOSFET Q2 are connected in common to a third terminal 14 serving as a reference voltage output terminal (Vr). The gate electrode of MOSFET Q2 is connected to the drain electrode thereof, and is thus grounded as shown in FIG. 1.

A series circuit of MOSTETs Q3, Q4 and Q5 is provided in parallel with the series circuit of MOSFETs Q1 and Q2. More specifically, the series circuit of MOSFETs Q3 and 4 is connected between the source and gate electrodes of MOSFET Q1 to serve as a high-impedance current source for supplying a constant d.c. current to MOSFET Q2. The source of MOSFET Q3 is connected to the source of MOSFET Q1. The drains of MOSFETs Q3 and Q4 are connected to the gates thereof, respectively. The drain of MOSFET Q4 is connected to the gate of MOSFET Q1, and connected to a fourth terminal 16, which also serves as the ground terminal Vss, via MOSFET Q5 functioning as a high-impedance resistor. The drain electrode of MOSFET Q5 is connected to its gate electrode. The sources of MOSFETs Q1 to Q5 are electrically conducted to the corresponding n type well regions, respectively, as designated by lines 18*a* 18*c* in FIG. 1.

The operation mode of this reference voltage generator will now be described hereinafter. Since MOSFET Q1 and the series circuit of MOSFETs Q3 and Q4 sever as high-impedance constant current sources for MOSFET Q2 serving as a resistor, a d.c. current is supplied to MOSFET Q2. Under this condition, a potential drop at the series circuit of MOSFETs Q3 and Q4 is represented by $2|Vth|$, where Vth shows a threshold voltage level of a negative value of each MOSFET. The potential drop is applied between the gate and source of MOSFET Q1 to define a gate-source voltage thereof. Therefore, MOSFET Q1 is biased such that it operates in a certain operation region of the current-voltage characteristic of pentodes wherein the gate-source voltage is kept constant irrespective of a potential value of the power supply voltage Vcc.

A constant current I1 thus flows to MOSFET Q2, and a potential drop is generated at MOSFET Q2. This potential drop defines a reference d.c. voltage level Vr of a positive polarity. In other words, the reference voltage Vr is higher than the ground potential Vss by a voltage corresponding to the potential drop at MOSFET Q2. In such an operation mode, if power supply voltage Vcc is fluctuated, charge carries tend to be accumulated in the gate of MOSFET Q1. The gate charge carries may be effectively discharged by MOSFET Q5 serving as a high-impedance resistor.

According to the voltage generating circuit described above, since the gate-source voltage of MOSFET Q1 can be maintained constant due the parallel connection of the series circuit of MOSFETs Q3 and Q4 even when the power supply voltage Vcc varies, a constant d.c. current I1 always flows through MOSFET Q2 which acts as the resistive element. As a result, irrespective of a variation in the power supply voltage Vcc, it is possible to invariably obtain a constant level reference d.c. voltage Vr at reference voltage output terminal 14 connected to the source of MOSFET Q2.

Further, according to the present invention, the insulated gate type transistors in the reference voltage generating circuit, that is MOSFETs Q1, Q2, Q3, Q4 and Q5, as shown in the equivalent circuit to FIG. 1, are formed in the semiconductor well regions situated at the surface portion of the semiconductor chip substrate and having the conductivity type opposite to that of the semiconductor chip substrate, thus preventing the threshold voltage level of the respective transistors from being fluctuated due to the substrate-biasing effect. It is possible to improve the reliability with which the reference voltage generating circuit is operated.

In this embodiment, MOSFETs Q1, Q2, Q3, Q4 and Q5 in the reference voltage generating circuit are all of the same channel conductivity type. Even if the fundamental characteristic of the field effect transistors in the reference voltage generating circuit is fluctuated due to a variation in the process parameters which is normally caused in the process for fabricating a reference voltage generating circuit on the semiconductor chip substrate, the influence of the fluctuation of the fundamental characteristic on the reference voltage generation operation can be minimized, the reason of which will be set forth below.

The structural constant $\beta$ of the respective MOSFET is defined by an equation below.

$$\beta=(W\epsilon\mu)/(Lt) \tag{1}$$

where

W: transistor channel width $\epsilon$: dielectric constant of gate oxide film $\mu$: mobility of carriers L: channel length t: thickness of the gate oxide film The structural constants of MOSFETS Q1, Q2, Q3, Q4 and Q5 in the reference voltage generating circuit are represented by $\beta 1$, $\beta 2$, $\beta 3$, $\beta 4$ and $\beta 5$, respectively, provided that, for ease of explanation, $\beta 3=\beta 4$ for MOSFETs Q3 and Q4 equal in W/L to each other.

When MOSFETs Q1 to Q5 are so formed in the surface portion of the semiconductor chip substrate as to have the same channel dose, the threshold voltage Vth of the MOSFETs are basically the same. In the circuit arrangement shown in FIG. 1, with I1 representing, among the power supply current flowing into power supply terminal 10, a current component flowing through MOSFETs Q1 and Q2 and I2 representing a current component flowing through MOSFETs Q3, Q4 and Q4 and Vg representing a gate potential of MOSFET Q1, the current component I2 is given below:

$$\begin{aligned} I2 &= (\beta 3/2)\cdot\{(Vcc-Cg)/2+Vth\}^2 \\ &= (\beta 5/2)/(Vg+Vth)2 \end{aligned} \tag{2}$$

Thus the gate potential Vg of MOSFET Q1 is expressed as follows:

$$Vg=\{Vcc-2(\nu 1-1)Vth\}/(2\nu 1+1) \tag{3}$$

noting that $$\nu 1 = \sqrt{\beta 5/\beta 3} = \sqrt{W5 \cdot L3/W3 \cdot L5} \quad (4)$$

The current I1 flowing through MOSFETs Q1 and Q2 is given by $$\begin{aligned} I1 &= (\beta 1/2) \cdot (Vcc - Vg + Vth)^2 \\ &= (\beta 2/2) \cdot (Vr + Vth)^2 \end{aligned} \quad (5)$$

Hence the reference voltage Vr at output terminal 14 is $$Vr = \nu 2(Vcc - Vg) - (1 - \nu 2)Vth \quad (6)$$

In equation (6), the constant $\nu 2$ has the following value defined below:

$$\nu 2 = \sqrt{\beta 1/\beta 2} = \sqrt{W1 \cdot L2/W2 \cdot L1} \quad (7)$$

From Equations (3) and (6) the reference d.c. voltage as obtained from the circuit of this embodiment is:

$$Vr = \nu 2\{1 - 1/(2\nu 1 + 1)\}Vcc - [1 - \{3 - 4/(2\nu 1 + 1)\}\nu 2]Vth \quad (8)$$

As evident from Equations (4) and (7), the constants $\nu 1$ and $\nu 2$ do not contain, as the process parameters, the dielectric constant $\epsilon$, carrier mobility M and gate oxide film thickness t. The channel length L and channel width W never exert any influence on the reference voltage Vr even if there is any difference between a theoretical design value and a actually obtained value with respect to the channel length L and channel width W. This is because, as evident from Equations (4) and (7), use is made of only a ratio between the channel length L and the channel width W in which case any difference between the theoretical value and the actual value of the channel length L and that between the theoretical value and the actual value of the channel width W are individually cancelled at the denominator and numerator of that ratio. Thus at the design stage of the IC pattern mask of reference voltage generating circuit 10 the aforementioned constants $\nu 1$ and $\nu 2$ can be set to arbitrary values merely by so determining the mask pattern as to have a desired dimension. Taking these into consideration, Equation (8) can be reduced to $$Vr = aVcc - bVth \quad (9),$$

provided that the new constants a and b are free constants as obtained by arbitrarily adjusting the constants $\nu 1$ and $\nu 2$.

Equation (9) indicates that, if only a variation in the threshold value of the respective MOSFETs is suppressed in the reference voltage generating circuit of this embodiment, it is possible to accurately obtain the power supply voltage Vcc-versus-reference voltage Vr characteristic as designed. Since, in general, the suppression of the variation in the threshold value of the MOSFET can be relatively readily controlled even in the present semiconductor fabricating process, it is possible to readily and exactly obtain a desirable power supply voltage-versus-reference voltage Vr characteristic. Further, it is designed that W3/L3 >>W5/L5, or the impedance of MOSFET Q5 is set to be sufficiently higher than those of MOSFETs Q3 and Q4, then in Equation (9) the constants $\nu 1$ and a can be near to zero. In this case, it is possible to obtain an ideal reference voltage generating characteristic which does not depend upon the power supply voltage Vcc.

Figure 2:
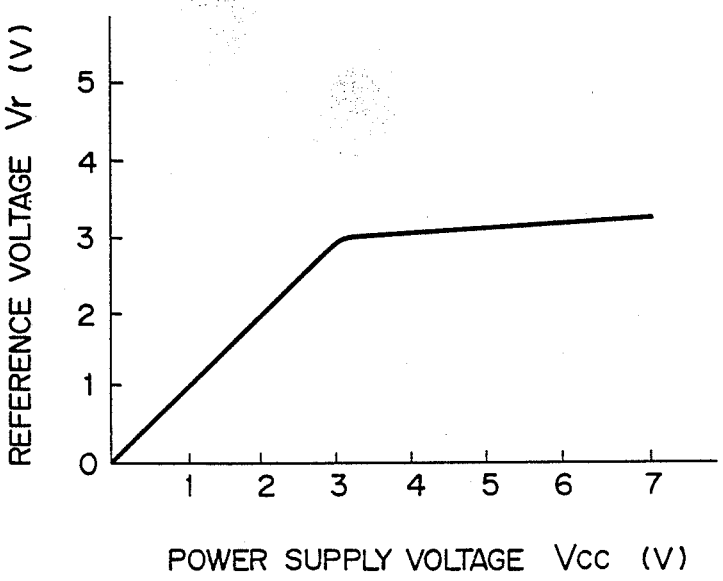
FIG. 2 is a graph illustrating an experimental characteristic of reference voltage (Vr) v.s. power supply voltage (Vcc) of the reference voltage generator such in FIG. 1.

FIG. 2 is a graph showing the power supply voltage Vcc-versus-reference voltage Vr characteristic, as experimentally measured, of reference voltage generating circuit as shown in FIG. 1. In this experimental example, the threshold value Vth of the respective MOSFET was set to −0.7 volt and the constants a and b in Equation (9) were set to 0.1 and 3.6, respectively, noting that $\nu 1^2$ and $\nu 2^2$ were set to $3.0 \times 10^{-4}$ and 9.0, respectively. As is evident from the characteristic curve graph of FIG. 2, it has been proved that with the power supply voltage Vcc at over 3 volts, the reference d.c. voltage Vr is maintained constant, irrespective of the value of the power supply voltage Vcc, i.e., irrespective of the variation in the power supply voltage Vcc.

Although the present invention has been described with reference to a specific embodiment, it shall be understood by those skilled in the art that numerous modifications may be made that are within the spirit and scope of the inventive contribution.

For example, in the above-presented embodiment, two MOSFETs Q3 and Q4 are used to constitute the constant current supply which biases MOSFET Q1 such that the gate-source voltage thereof is kept constant. However, three or more series-connected MOSFETs can be used if they have the same channel type as the remaining MOSFETs in this reference voltage generator. Further, a high impedance resistor using a polycrystalline silicon film or a diffusion layer may be used in place of MOSFET Q5 for discharging carries accumulated in the gate of MOSFET Q1.

Furthermore, although the p channel type MOSFETs are used in the above embodiment circuitry, n channel type MOSFETs may be used as transistors Q1 to Q5.

What is claimed is:

1. A device for generating a d.c. reference voltage, comprising:

first transistor means for serving as a constant current source which receives a power supply voltage to produce a d.c. current, said first transistor means comprising a field effect transistor having source and gate electrodes;

second transistor means connected in series to said first transistor means, for serving as a resistor element which receives the d.c. current to generate a d.c. voltage as the reference voltage; and third transistor means connected in parallel with said first transistor means, for stabilizing said reference voltage by controlling the current flowing in said first transistor means such that said current is kept constant irrespective of change in the power supply voltage, said third transistor means comprising, two series-connected field effect transistors each having a threshold voltage drop Vth across the source and drain thereof, said two series-connected field effect transistors connected directly between said source and gate electrodes of said first transistor means, for generating a constant potential drop 2Vth which is applied between said gate and said source electrodes of sid field effect transistor of said first transistor means to cause a constant voltage 2Vth therebetween, whereby the d.c. current flowing in said first transistor means is kept constant even when said power supply voltage is varied.

2. The device according to claim 1, wherein each of said field effect transistors of said third transistor means has a gate electrode and a drain electrode connected to said gate electrode.

3. The device according to claim 2, wherein further comprising:

resistor means connected to said first transistor means, for discharging charge carriers accumulated in the gate of said first transistor means.

4. The device according to claim 3, wherein said field effect transistor of said resistor means has a source electrode connected to the gate electrode of said first transistor means, and a drain electrode and a gate electrode which are connected to each other.

5. The device according to claim 4, wherein said second transistor means comprises a field effect transistor having a source electrode connected to the drain electrode of said first transistor means, and a drain electrode and a gate electrode which are connected to each other.

6. The device according to claim 5, wherein said field effect transistors of said first, second and third transistor means and said resistor means have the same channel conductivity type.

7. The device according to claim 1, wherein said third transistor means generates said potential drop as a gate-source voltage for said first transistor means, and biases said first transistor means such that it operates in a certain operation region of a current-voltage characteristic of pentodes.

8. A reference voltage generating circuit used in a semiconductor integrated circuit device, comprising:

a first field effect transistor serving as a constant current source which receives a power supply voltage to produce a d.c. current, said first transistor having a source electrode and a gate electrode;

a second field effect transistor connected in series to said first transistor, for serving as a resistor element which receives the d.c. current to generate a d.c. voltage as the reference voltage; and a predetermined number n ($n \geqq 2$) of field effect transistors connected between said source and gate of said first transistor, for stabilizing the reference voltage by causing the d.c. current flowing in said first transistor to be kept constant irrespective of change in the power supply voltage, said transistors being series-connected field effect transistors which are connected directly between said source and gate electrodes of said first transistor, each having a threshold voltage drop Vth across the source and drain of each of said series connected transistor, said series connected field effect transistors generating a potential drop nVth which is applied between said source and gate electrodes of said first transistor to cause a gate-source voltage thereof to remain constant, whereby the d.c. current flowing in said first transistor is kept constant even when said power supply voltage is varied.

9. The circuit according to claim 8, wherein said first to fourth transistors comprise metal oxide semiconductor field effect transistors of one channel conductivity type, each of which has a threshold voltage level which is substantially the same as those of the remaining transistors.

10. The circuit according to claim 9, further comprising:

a fifth field effect transistor having a source electrode connected to the gate electrode of said first transistor, for serving as a second resistor element for discharging charge carriers accumulated in said gate of said first transistor.

11. The circuit according to claim 10, wherein each of said first to fifth transistors has a drain electrode connected to the gate electrode thereof.

* * * * *